US008638038B2

(12) United States Patent
Ge et al.

(10) Patent No.: US 8,638,038 B2
(45) Date of Patent: Jan. 28, 2014

(54) SYSTEM FOR REPROGRAMMING POWER PARAMETERS FOR LIGHT EMITTING DIODES

(75) Inventors: Henry Ge, Vanke (CN); Leslie Leong, Chancery Court (SG)

(73) Assignees: STMicroelectronics (Shenzhen) R&D Co., Ltd., Shenzhen (CN); STMicroelectronics Asia Pacific PTE, Ltd., Singapore (SG)

( * ) Notice: Subject to any disclaimer, the term of this patent is extended or adjusted under 35 U.S.C. 154(b) by 135 days.

(21) Appl. No.: 13/302,078

(22) Filed: Nov. 22, 2011

(65) Prior Publication Data

US 2012/0133284 A1 May 31, 2012

(30) Foreign Application Priority Data

Nov. 22, 2010 (CN) ..... 2010 1 0560561

(51) Int. Cl.
*H05B 37/03* (2006.01)
*H05B 37/02* (2006.01)

(52) U.S. Cl.
USPC ..... 315/185 R; 315/121; 315/297; 315/307

(58) Field of Classification Search
USPC ..... 315/185 R, 121, 307, 297, 186, 193, 315/210, 312, 313, 320
See application file for complete search history.

(56) References Cited

U.S. PATENT DOCUMENTS

2010/0156315 A1* 6/2010 Zhao et al. ..... 315/294
2011/0012521 A1* 1/2011 Byun et al. ..... 315/186

* cited by examiner

*Primary Examiner* — Daniel D Chang
(74) *Attorney, Agent, or Firm* — Munck Wilson Mandala, LLP

(57) ABSTRACT

According to an embodiment of the present disclosure, a plurality of light-emitting diode (LED) modules in series are monitored. When an LED module is detected as failing or operating inadequately, a bypass switch removes the particular LED module from the series and the voltage provided to the series is modified. When the LED modules are detected as having too high of a temperature, the current provided to the LED modules is limited.

20 Claims, 4 Drawing Sheets

SYSTEM FOR REPROGRAMMING POWER PARAMETERS FOR LIGHT EMITTING DIODES

CROSS-REFERENCE TO RELATED APPLICATIONS AND CLAIM OF PRIORITY

This application claims priority under 35 U.S.C. §119(a) to a Chinese patent application filed in the State Intellectual Property Office of the People's Republic of China on Nov. 22, 2010 and assigned Serial No. 201010560561.9, the entire disclosure of which is hereby incorporated by reference.

TECHNICAL FIELD

The present disclosure is directed, in general, to systems with light emitting diodes, and more specifically, to a system for reprogramming power parameters for light emitting diodes.

BACKGROUND

Conventional light emitting diode (LED) modules may be provided in a parallel DC/DC Buck circuit design. In such a design, a Vbus is provided with a fixed voltage and a fixed current. A plurality of DC/DC converters are coupled in parallel to the fixed Vbus, respectively converting the fixed Vbus voltage to a particular voltage desired by a connected LED module. Such a conventional Buck circuit design is not only cost prohibitive, but is also inefficient.

There is, therefore, a need in the art for an improved LED system.

SUMMARY

According to an embodiment of the present disclosure, a plurality of light-emitting diode (LED) modules in series are monitored. When an LED module is detected as failing or operating inadequately, a bypass switch removes the particular LED module from the series and the voltage provided to the series is modified. When the LED modules are detected as having too high of a temperature, the current provided to the LED modules is limited.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 4B, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system.

Given the difficulties described in the background, certain embodiments of the disclosure teach use of a variable and reprogrammable Vbus. In certain embodiments, a plurality of LED modules may be connected in series to the reprogrammable Vbus. Additionally, in certain embodiments, the LED modules may have bypass features that allow the bypass of a failed LED module. Furthermore, in certain embodiments the Vbus can be modified, according to the LED modules that are currently online and not bypassed.

Figure 1:
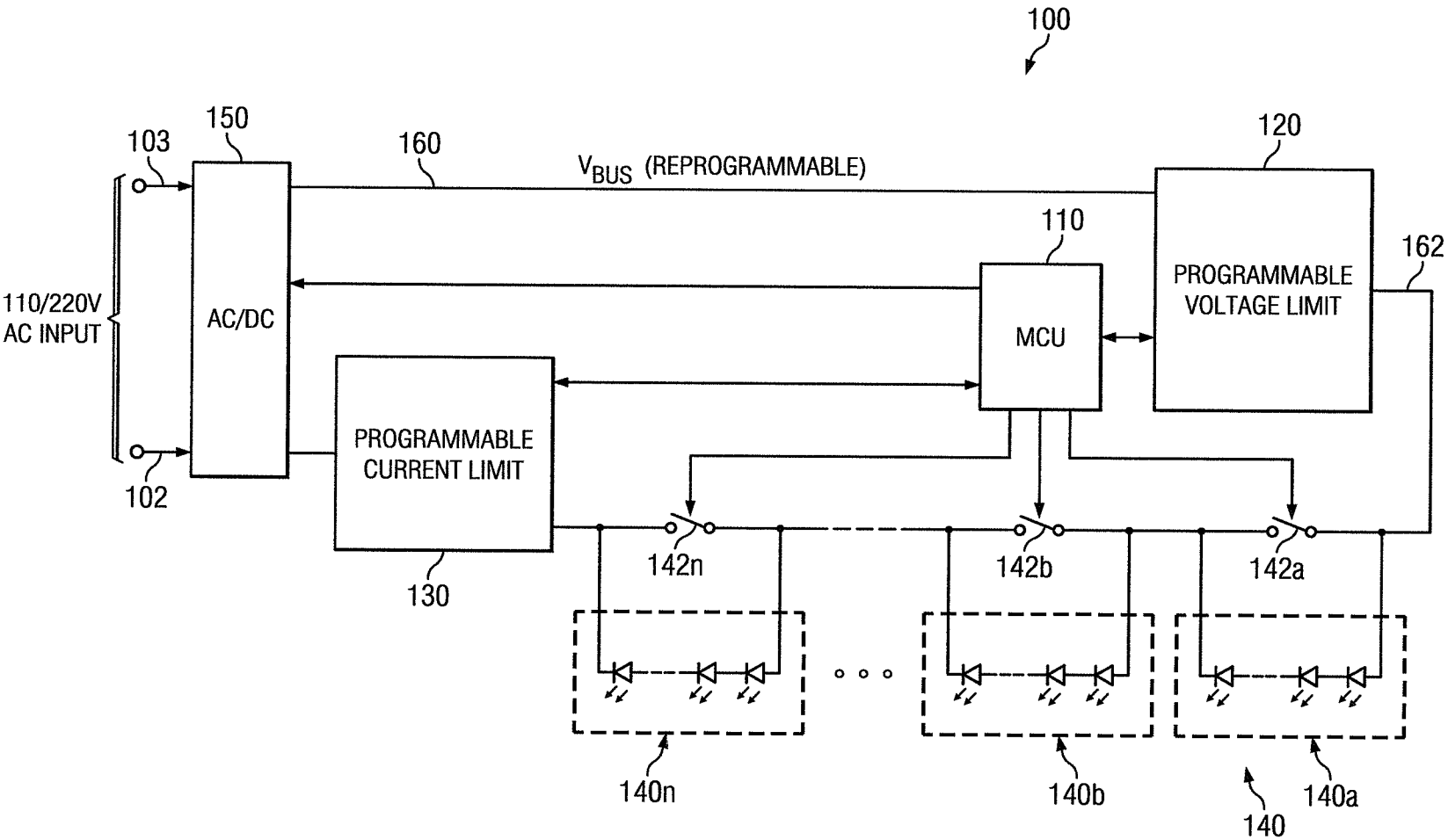
FIG. 1 is a simplified circuit diagram of a light emitting diode (LED) system in accordance with one embodiment of the present disclosure.

FIG. 1 is a simplified circuit diagram of a light emitting diode (LED) system 100 in accordance with one embodiment of the present disclosure. The LED system 100 of FIG. 1 includes a microcontroller unit (MCU) 110, programmable voltage limit features 120, programmable current limit features 130, a plurality of LED modules 140 (e.g., 140*a*, 140B, 140*n*), and an AC/DC converter 150.

Figure 2:
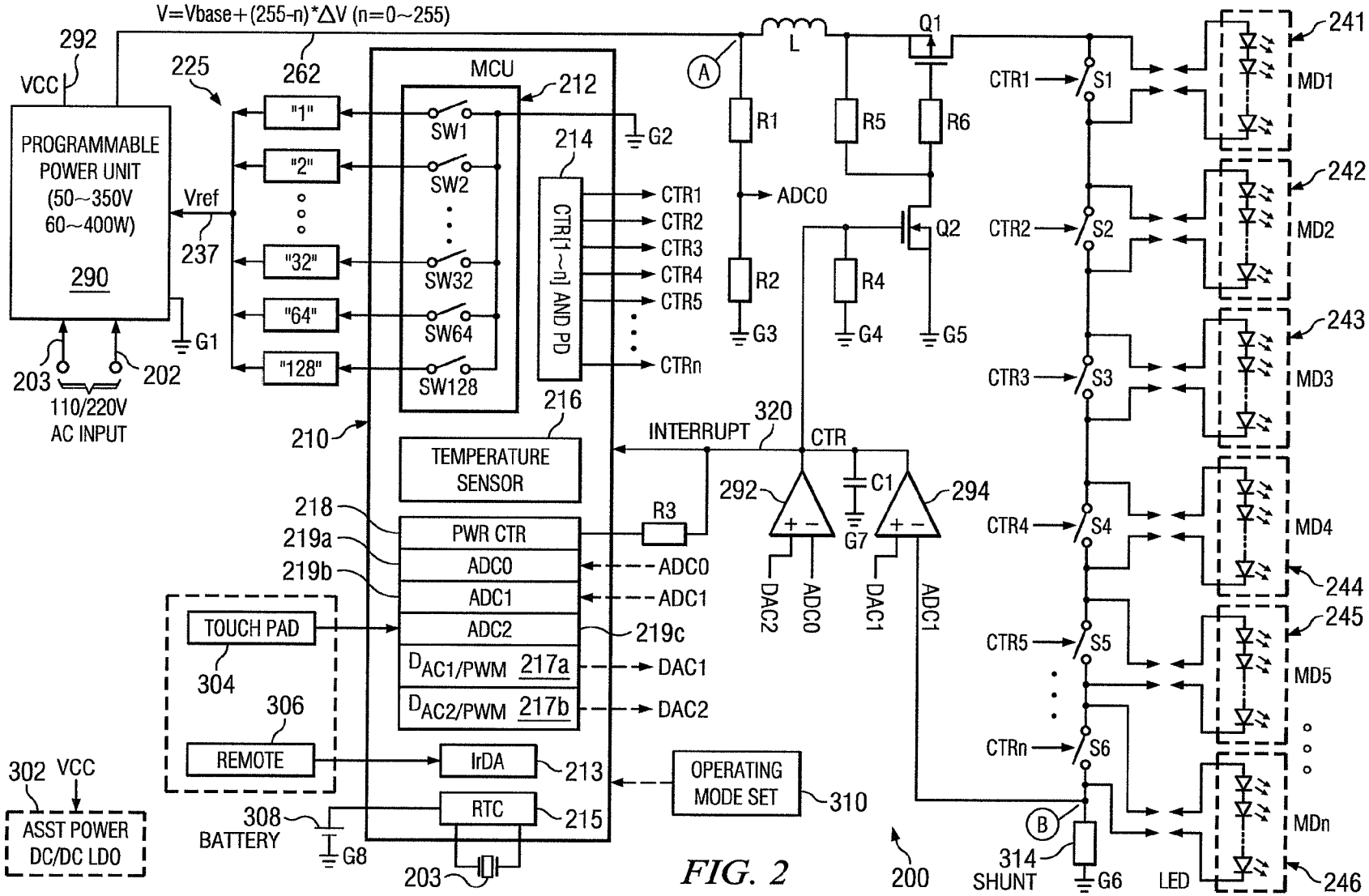
FIG. 2 is a more detailed circuit diagram of a light emitting diode (LED) system in accordance with one embodiment of the present disclosure.

The AC/DC converter 150 generally receives an alternating current input, for example, 110V/220V from inputs 102 and 103, and provides a direct current output, which is designated in FIG. 2 as $V_{BUS}$ 160. As described below, the current and voltage of $V_{BUS}$ 160 is modified or reprogrammed according to the operation of the LED system 100. As two non-limiting examples, the voltage of $V_{BUS}$ 160 may be modified according to the number of the LED modules 140 in use, for example, using a programmable voltage limit feature 120 to yield a modified $V_{BUS}$ 162. Additionally, the current provided the LED modules 140 may be modified according to a temperature of the LED modules 140 by using a programmable current limit feature 130. Further details of each will be described below.

The plurality of LED modules 140 (designated respectively as 140*a*, 140*b*, 140*n*) are shown connected to one another in series. Although only three LED modules 140 are shown in this embodiment, other embodiments may have more or less LED modules. Additionally, although a particular configuration of an LED module is shown in this embodiment, other embodiments may include other LED module designs.

The MCU 110 is a controller that is in communication with each of the plurality of the LED modules 140. The MCU 110 can selectively engage switches 142*a*, 142*b*, 142*n* on each respective LED module 140*a*, 140*b*, 140*n*, allowing the LED module 140 to be bypassed in the series. The MCU 110 can also modify the voltage provided to the LED modules 140*a*, 140*b*, 140*n* using programmable voltage limit features 120. As one example, a particular value for $V_{BUS}$ 160 may be provided as an output from the AC/DC converter 150 and the programmable voltage limit feature 120 may adjust that value to yield a modified $V_{BUS}$ 162. Additional details of the programmable voltage limit features 120 are described below with reference to FIGS. 2 and 3.

The MCU 110 can additionally modify the current supplied to the LED modules using the programmable current limit features 130. As one example, in particular embodiments, the MCU 110 may sense that the temperature of one or more LED module 140 has risen to an undesirable level. Accordingly, the MCU 110 may use the programmable current limit features 130 to limit the current provided to the LED modules 140*a*, 140*b*, and 140*n*. Additional details of the programmable current limit features 130 are described below with reference to FIGS. 2 and 3.

FIG. 2 is a more detailed circuit diagram of a light emitting diode (LED) system 200 in accordance with one embodiment of the present disclosure. Although a particular configuration of the LED system 200 is shown, other configurations may be utilized, including LED systems with more, less, or different components.

An MCU 210 is shown with various modules. In one embodiment, the MCU 210 may be an MCU sold by the assignee of the current application under the "STM32" family of MCUs. The MCU 210 may include a central processing unit, memory, and logic. The logic may be embedded as software, hardware, or a combination of software and hardware. The embedded logic may be operable to perform the processes described herein. The MCU 210 may additionally have a variety of communication interfaces (digital and analog alike) for communicating with other components.

The MCU 210 of this embodiment includes a port module 212, a CTR & PD module 214, a temperature sensor module 216, a Pwr CTR module 218, two analog to digital converters/pulse width modulator modules (DAC1/PWM 217*a*, DAC2/PWM 217*n*), three analog to digital converters (ADC0 219*a*, ADC1 219*b*, and ADC2 219*c*), an infrared module (IrDA 213), and a real-time clock (RTN 215). Although specific components of the MCU 210 are shown in this embodiment, other MCUs may include more, less, or different components.

The MCU 210 operates as a controller. The general purpose of the MCU 210 is to ensure adequate operation of the LED modules 240 (designated respectively as MD1, MD2, MD3, MD4, MDn). In particular, as described in more details below, the MCU 210 in particular embodiments not only controls voltage and current supplied to the LED modules 240, but also may selectively engage a bypass switch for particular LED modules when such LED modules 240 fail or are operating inadequately.

Although not expressly shown, the MCU 210 in particular embodiments can detect failure or inadequate operation of each particular LED module 240. In particular embodiments, the MCU 210 directly handles such detection. In other embodiments, another module (not shown) may handle the detection and send information to the MCU 210. When failure or inadequate operation is detected, the MCU 210 can use the CTR & PD module 214 to send a signal through one of the respective communication paths CTR1, CTR2, CTR3, CTR4, CTR5 . . . CTRn to engage a bypass switch S1, S2, S3, S4, S5, . . . Sn, allowing a particular LED module 240 to be bypassed. In certain embodiment, the CTR & PD module 214 may also reengage a particular bypass switch S1, S2, S3, S4, S5, . . . Sn when the MCU 210 has detected that a particular LED module 240 is again operational.

To change the voltage supplied to the LED modules 240, the MCU 210 can use the port module 212. In particular, the port module 212 can close switches SW1, SW2, SW32, SW64, SW128 to one or more resistor registers, which are respectively labeled in FIG. 2 as "1," "2," . . . "32," "64," and "128." The number and ones of the resistor registers 225 that are closed may depend on the number and ones of particular LED modules 240 that are bypassed. In some embodiments, the LED modules 240 may not all be the same and may have varying requirements. In other embodiments, some or all of the LED modules 240 may be the same. As described with reference to FIG. 3, the closing of switches SW1, SW2, SW32, SW64, SW128 and engaging of particular resistor registers will modify a Vref value 237. In response to this varied Vref value 237, the voltage value 262 supplied to the LED modules will be modified. The voltage value 262 supplied to the LED modules is shown by a formula: V=Vbase+(255-n)*ΔV, which will be described with reference to FIG. 3.

In the embodiment of FIG. 2, the current supplied to the LED modules is modified using the DAC1/PWM module 217*a* and/or the DAC2/PWM module 217*b*. In particular, the DAC1/PWM module 217*a* and/or DAC2/PWM module 217*b* may provide desired set values for current and/or voltage, which are respectively shown as DAC1 and DAC2. The values (DAC1 and DAC2) of the DAC1/PWM module 217*a* and/or the DAC2/PWM module 217*b* in this embodiment are provided to two comparators 292, 294.

The actual values of the LED system 200 are measured using input received at the ADC0 module 219*a* and the ADC1 module 219*b* (the inputs respectively shown as ADC0 and ADC1). The values for the ADC0 module 219*a* (shown as ADC0) come from the comparator 292 and input in the circuit between two resistors R1 and R2. The values for ADC1 module 219*b* (shown as ADC1) may come from the other comparator 294. In particular embodiments, the values of ADC0 are compared to the values of DAC2 and the values of ADC1 are compared to the values of DAC1. When differences are detected, modifications can be made to the LED system 200 to modify the current. For example, one or both of the MOSFET switches (Q1 and Q2) can either be opened or closed. In particular embodiments, the ADC0 values may measure Vbus voltage whereas the ADC1 values may represent the current limiter.

As a first non-limiting example, ADC0 voltage values may be compared with DAC2 voltage values. If the voltage value of ADC0 is bigger than voltage value of DAC2, then Q1 may be shut off. As another non-limiting example, DAC1 voltage values may be compared with ADC1 voltage values. If the ADC1 voltage value is higher than the DAC1 voltage value, then Q1 may be shut off and the current may be limited.

The temperature sensor module 216 can measure the temperature at each respective LED module 240 or as a collection of LED module's 240. As one example, the temperature of a heat sink on each respective LED module 240 or a collective heat sink in communication with one or more LED modules 240 may be communicated to the temperature sensor module 216. Upon detection that one or more of the LED modules 240 are reaching an undesirable value, the current supplied to the LED modules 240 can be modified using the values of DAC1/DAC2 and ADC0/ADC2 described above.

In addition to the above controls, the LED system 200 may also have an interrupt control feature, which can monitor conditions in the circuit and make changes to one or both of the current values or voltage values separate from the DAC1/DAC2 values referenced above.

A programmable power unit 290 is shown to the left of the MCU 210 in FIG. 2. The programmable power unit 290 receives an alternating current input, for example, 110V/220V from input 202 and 203, and provides a direct current output value 262 that varies according to the Vref input 237 received. As a non-limiting example, the direct current output may vary between 50-350V and 60-400 W. In other embodiments, these respective values may be higher or lower. A collector common voltage, VCC 292, is also shown. The particular formula for the direct current output is described in more details with reference to FIG. 3.

In particular embodiments, the LED system 200 may contain various other features including a Low Dropout Regulator 302 (DC/DC LDO); a touch pad 304 and remote 306 that provides input to the IrDA module 213 and/or the ADC2 219*c*, for example, to specify a dimming of the LED modules 240; batteries 308; a piezo transducer 203; and an operating mode set 310 that provide parameters for certain operations of the LED system 200.

Additionally, an interrupt line 320 may provide feedback to the MCU 210 for modifying the current and/or voltage applied to the system 200.

There are additionally other particular components, for example, grounds (G1, G2, G3, G4, G5, G6, G7, and G8), resistors (R3, R4, R5 and R6), inductor $L_1$, shunt 314, and capacitor $C_1$. The specific operation of such components will become apparent from FIG. 2.

In particular embodiments, the circled A and circled B symbols designate points at which may voltage and/or current may be measured in the system, for example, before and after the series of LED modules 240.

Figure 3:
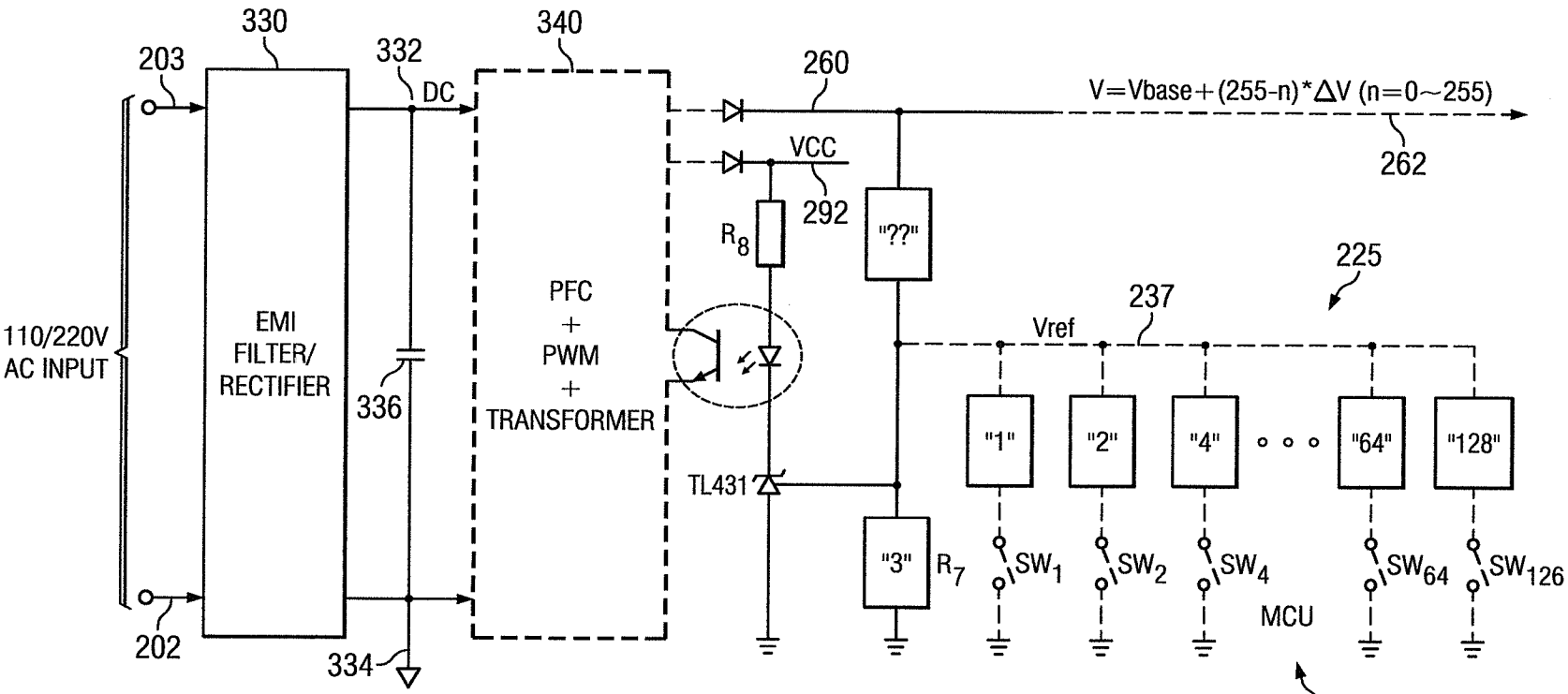
FIG. 3 shows more details of the programmable power unit scheme of FIG. 2.

FIG. 3 shows more details of the programmable power unit scheme 290 of FIG. 2. AC input is shown on the left with 110V/220V from inputs 202 and 203 passed to an Electromagnetic Interference (EMI) filter/rectifier 330. The direct current output 332 of the EMI Filter/rectifier 330 is passed to a module 340 with a combined power factor correction (PFC), pulse width modulation (PWM) and transformer. Another line signaling 334 in parallel with the direct current output 332, but separated with a capacitor 336, is also passed to the module 340.

A collector common voltage, VCC 292, is shown (also shown in FIG. 2), which may have a value of between 5-35 V in this embodiment. A voltage reference, TL431, is also shown, which may have a value of 2.5V. In other embodiments, the values for the VCC 292 and voltage reference, TL431, may be lower or higher.

As described above, the voltage value 262 is dependent on the value of Vref 237. The value of Vref 237 is dependent on the number and ones of the register resistors 225 (labeled as "1", "2," . . . "32," "64," and "128") that are engaged by closing one or more of the switches SW1, SW2, SW4, SW64, SW128. The programmable voltage value (or Vbus) 262 is shown as a being a function of a minimum voltage, Vbase, added to the product of the number of LED modules currently in the series and voltage values associated therewith, for example, 0.5 V to 1.5 V in particular embodiments. In this particular embodiment, the number of modules is shown as 255; however, in other embodiments the number of LED module may be more than or less than 255. There may also be two other resistors R7 and R8, respectively in series and parallel with the Vref value 237.

Figure 4A:
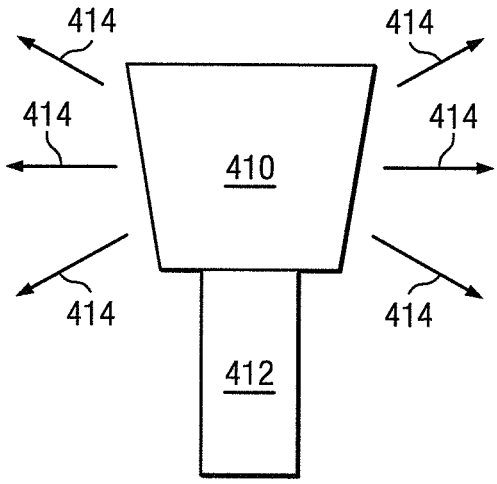
FIGS. 4A and 4B show example integrations of the LED system in accordance with embodiments of the disclosure.

The LED system described above with reference to FIGS. 1-3 may be used in any of a variety of settings, including general lighting with LEDs (e.g., a street lamp) and LED back-lighting for televisions. FIG. 4A shows the LED system integrated into a general lighting whereas FIG. 4B shows the LED system integrated into a television.

With reference to FIG. 4A, a lamp housing 410 is shown on top of a lamp base 412 that may be part of a street lamp. The components shown in FIGS. 1-3 may be in one or both of the lamp housing 410 or the lamp base 412. Generally, at least the LED modules 140, 240 may be located in the lamp housing 410 to provide lighting (indicated by arrows 414). The lamp housing 410 may include any traditional features associated with lighting, for example, glass or plastic casing (to cover the LED modules 140, 240 while allowing light to pass), reflectors (to reflect light from the LED modules), and the like. Although a particular configuration of general lighting is shown, the LED systems 100, 200 of FIGS. 1-3 may be integrated into other types of lighting, for example, directional lights that focus in a particular direction. Additionally, the LED system of FIGS. 1-3 may be incorporated in variety of different types of lights, for example, lights for automobiles, security lights, and the like. Additionally, in certain embodiments, some or all of the components of FIGS. 1-3 may be utilized. For example, in particular embodiments, a direct current may be provided. Accordingly, an AC/DC converter may not be necessary.

Figure 4B:
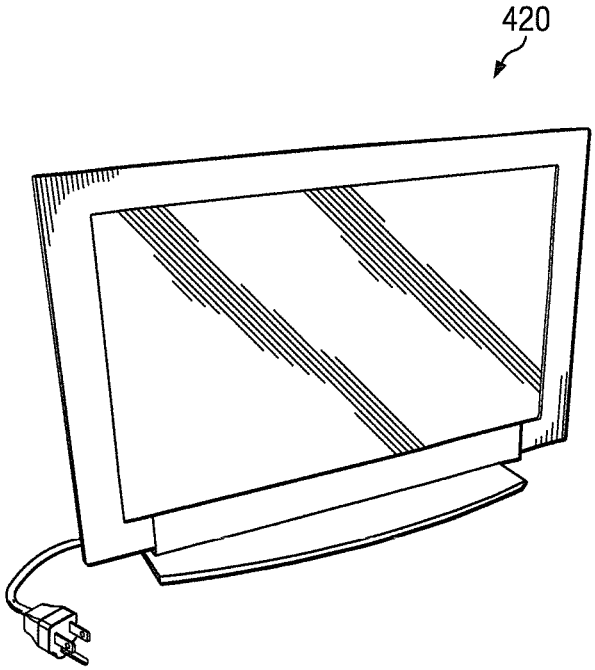

With reference to FIG. 4B, a television 420 is shown. The LED system 100,200 of FIG. 1-3 may be integrated as the backlighting for the television 420, which may be an LCD television, an LED television, or other type of television. Similar to FIG. 4A, all or some of the components of the systems 100, 200 of FIGS. 1-3 may be utilized.

Although the above description is made in connection with specific exemplary embodiments, various changes and modifications will be apparent to and/or suggested by the present disclosure to those skilled in the art. It is intended that the present disclosure encompass all such changes and modifications as fall within the scope of the appended claims.

What is claimed is:

1. A system comprising:

a plurality of light-emitting diode (LED) modules arranged in series;

a reprogrammable bus configured to provide power to the LED modules; and a microcontroller unit configured to modify a voltage of the reprogrammable bus, wherein at least some of the plurality of LED modules in the series are selectively electrically coupled to one another, and the reprogrammable bus is selectively electrically coupled to at least some of the plurality of LED modules in the series.

2. The system of claim 1, wherein the microcontroller unit modifies a voltage of the reprogrammable bus when at least one LED module of the plurality of LED modules is detected as failing or operating inadequately.

3. The system of claim 1, wherein at least some of the plurality of LED modules are selectively electrically coupled to one another, and the reprogrammable bus is selectively electrically coupled to at least some of the plurality of LED modules.

4. The system of claim 1, wherein at least some of the, plurality of LED modules include a corresponding bypass switch, the bypass switch configured to selectively electrically couple or decouple an LED module to the reprogrammable bus.

5. The system of claim 4, wherein the microcontroller unit is further configured to engage the bypass switches.

6. The system of claim 4, wherein the microcontroller unit modifies the voltage of the reprogrammable bus in accordance with the number of bypass switches that have been engaged.

7. The system of claim 1, wherein the microcontroller unit is further configured to modify current supplied to the plurality of LED modules.

8. The system of claim 7, wherein the microcontroller unit modifies the current according to a temperature of the LED modules.

9. A method comprising:

detecting an operation of a plurality of light-emitting diode (LED) modules arranged in series in a circuit;

in response to the detected operation of the LED modules, modifying at least one of a voltage or a current provided to the plurality of LED modules; and selectively electrically decoupling at least one of the LED modules from the series based upon the detected operation of the LED modules.

10. The method of claim 9, wherein detecting the operation of the plurality of LED modules includes detecting at least one of a temperature of the LED modules, failure of each of the LED modules, or inadequate operation of each of the LED modules, the circuit including at least one switch, the method further comprising:

engaging the at least one switch to selectively electrically decouple at least one of the LED modules from the series upon detecting the temperature of the LED module above a predefined threshold, detecting failure of an LED module, or detecting inadequate operation of an LED module.

11. The method of claim 9, wherein detecting the operation of the plurality of LED modules includes detecting a temperature of the LED modules, and modifying the current provided to the plurality of LED modules according to the temperature of the LED modules.

12. The method of claim 9, wherein detecting the operation of the plurality of LED modules includes detecting a failure of each of the LED modules or an inadequate operation of each of the LED modules, and the voltage provided to the plurality of LED modules is modified according to the detected failure or inadequate operation of at least one of the plurality of LED modules.

13. The method of claim 9, further comprising:

selectively electrically decoupling at least one of the LED modules from the series upon detecting a failure or inadequate operation of the at least one of the LED modules.

14. The method of claim 13, further comprising:

modifying the voltage provided to the plurality of LED modules according to the number of LED modules in the series.

15. An apparatus comprising:

a processing system; and stored logic, the stored logic when executed configured to:

detect an operation of a plurality of light-emitting diode (LED) modules arranged in series in a circuit in response to the detected operation of the LED modules, modify at least one of a voltage or a current provided to the plurality of LED modules, and selectively electrically decouple at least one of the LED modules from the series based upon the detected operation of the LED modules.

16. The apparatus of claim 15, wherein the logic when detecting the operation of the plurality of LED modules detects at least one of a temperature of the LED modules, failure of each of the LED modules, or inadequate operation of each of the LED modules, the circuit including at least one switch, the logic further configured to:

engage the at least one switch to selectively electrically decouple at least one of the LED modules from the series upon detecting the temperature of the LED module is above a predefined threshold, detecting failure of an LED module, or detecting inadequate operation of an LED module.

17. The apparatus of claim 15, wherein the logic in detecting the operation of the plurality of LED modules detects a temperature of the LED modules, and the logic modifies the current provided to the plurality of LED modules according to the temperature of the LED modules.

18. The apparatus of claim 15, wherein the logic in detecting the operation of the plurality of LED modules detects a failure of each of the LED modules or inadequate operation of each of the LED modules, and the logic modifies the voltage provided to the plurality of LED modules according to the detected failure or inadequate operation of at least one of the plurality of LED modules.

19. The apparatus of claim 15, wherein the logic is further configured to:

selectively electrically decouple at least one of the LED modules from the series upon detecting a failure or inadequate operation of the at least one of the LED modules.

20. The method of claim 19, wherein the logic modifies the voltage provided to the plurality of LED modules according to the number of LED modules in series.

* * * * *